United States Patent [19]

Borriello

[11] Patent Number: 4,787,664

[45] Date of Patent: Nov. 29, 1988

[54] ELECTROMECHANICAL APPARATUS FOR HOLDING AND TURNING OVER HOLLOW CYLINDRICAL BODIES, IN PARTICULAR ROLLED STEEL COILS

[75] Inventor: Aleardo Borriello, Zane', Italy

[73] Assignee: Trasmec S.A.S. Di Valtorta Italo E C., Macherio, Italy

[21] Appl. No.: 31,067

[22] PCT Filed: Jul. 7, 1986

[86] PCT No.: PCT/EP86/00399

§ 371 Date: Apr. 23, 1987

§ 102(e) Date: Apr. 23, 1987

[87] PCT Pub. No.: WO87/00156

PCT Pub. Date: Jan. 15, 1987

[30] Foreign Application Priority Data

Jul. 10, 1985 [IT] Italy ..... 21525 A/85

[51] Int. Cl.[4] ..... B66C 1/22

[52] U.S. Cl. ..... 294/103.2

[58] Field of Search ..... 294/103.2, 67.5, 86.41, 294/81.3, 67.21, 82.12; 414/626, 484, 783, 910, 911; 212/117, 129

[56] References Cited

U.S. PATENT DOCUMENTS 2,897,990 8/1959 Kendall ..... 294/103.2

3,153,555 10/1964 Kaplan et al. ..... 294/103.2

FOREIGN PATENT DOCUMENTS 865766 9/1981 U.S.S.R. ..... 294/103.2

*Primary Examiner*—James B. Marbert

*Attorney, Agent, or Firm*—Young & Thompson

[57] ABSTRACT

An electromechanical apparatus for handling and tilting hollow cylindrical bodies (R) such as reels of sheet metal, comprising a rotational clamp (31) having two jaws (32 and 33) which hold, by a nut (36) travelling along a rotating screw (35) driven by a motor (34), the external and internal walls respectively of the cylindrical body (R). The rotating clamp is connected to a crane hooking device by a support (20, 20') moving along a guide (30) provided on the rotating clamp body (31). The hold on the internal wall of the body (R) takes place only along a portion of it, and a device (13, 38b, 37, 38; 40) is provided to compensate the reduction in the holding force produced during the rotation of the hollow cylindrical body (R), namely, the compensating means (13, 38*b*, 37, 38; 40) causes an additional movement of the rotating screw (35) in a direction to move the jaws closer together.

6 Claims, 5 Drawing Sheets

FIG. 1
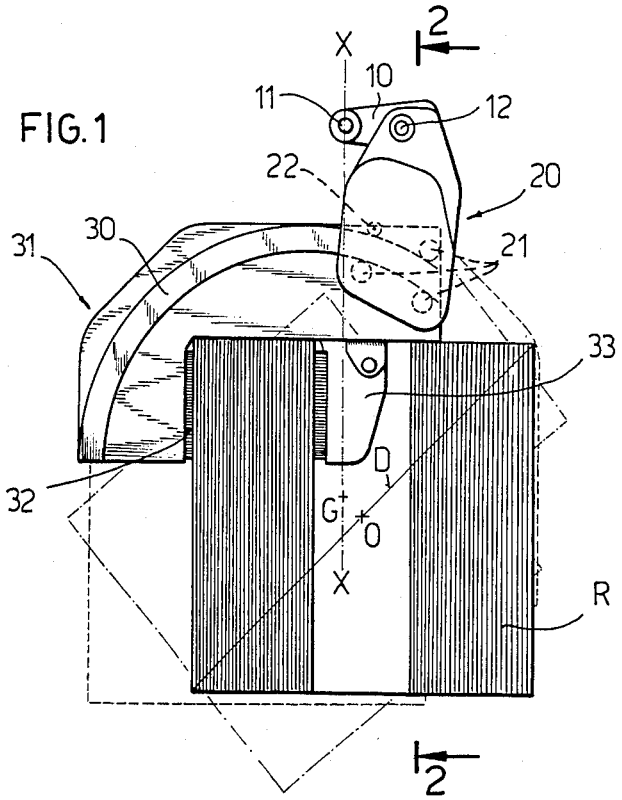
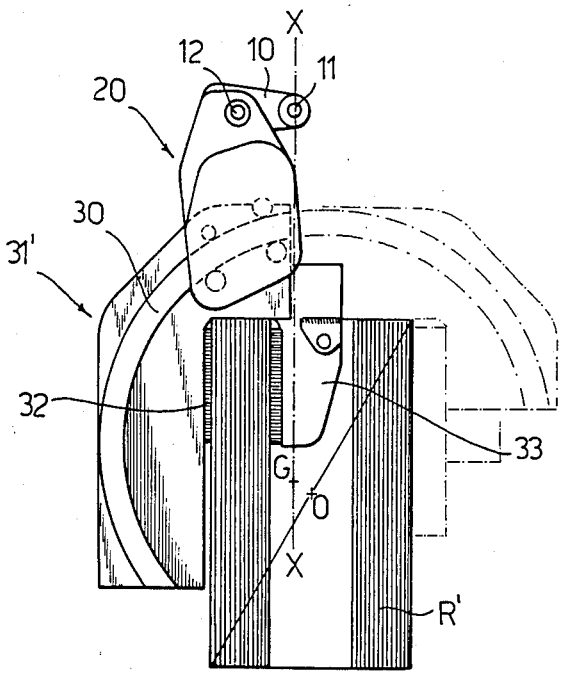
FIG. 4

ELECTROMECHANICAL APPARATUS FOR HOLDING AND TURNING OVER HOLLOW CYLINDRICAL BODIES, IN PARTICULAR ROLLED STEEL COILS

The present invention relates to means necessary to enable a crane to move (lift, lower, turn over and eventually transport) hollow cylindrical bodies, for instance rolled steel sheets normally called "coils".

As known, it is necessary in industry to move, for instance, rolls of sheet steel, in a safe and practical way, regardless of whether their axis is vertical or horizontal.

Normally these coils are produced and used when their axis is horizontal, while for heat treatment, storage and transport it is preferred to have the coils with their axis in a vertical position.

Devices which can be hung to a crane hook have thus been carried out, capable of rotating the rolled steel sheets (No. DE-B-1.255.887). They foresee a vise which grips a coil from inside and from outside and then rotates driven by an engine which moves on a rack integral with the vise.

It often happens that among the rolled sheets extraneous bodies are trapped such as ice, dust or burrs of the steel sheet itself. When the coil is gripped and rotated, the extraneous body slips away or is compressed, thus reducing the thickness between the jaws; this entails a reduction of the holding force with the danger that the coil slips away from the holding means.

There is also a need to use up to the maximum the height of the stores where the rolls of sheet steel are kept, as well as the useful height of the crane-hooks, which up to now have not been used fully.

The aim of the present invention is thus to overcome these obstacles and produce a device for cranes, of minimum encumbrance, which can lift a hollow cylindrical body having either a horizontal or a vertical axis, providing also for its rotation and for compensation of a possible reduction in the holding force.

The invention will now be better understood by means of exemplary embodiments which are shown in the attached drawings, in which:

FIG. 1 is a side-view of a first embodiment in which the dotted lines show different working positions;

FIG. 4 is a view of another embodiment for very tall and narrow coils.

Figure 3:
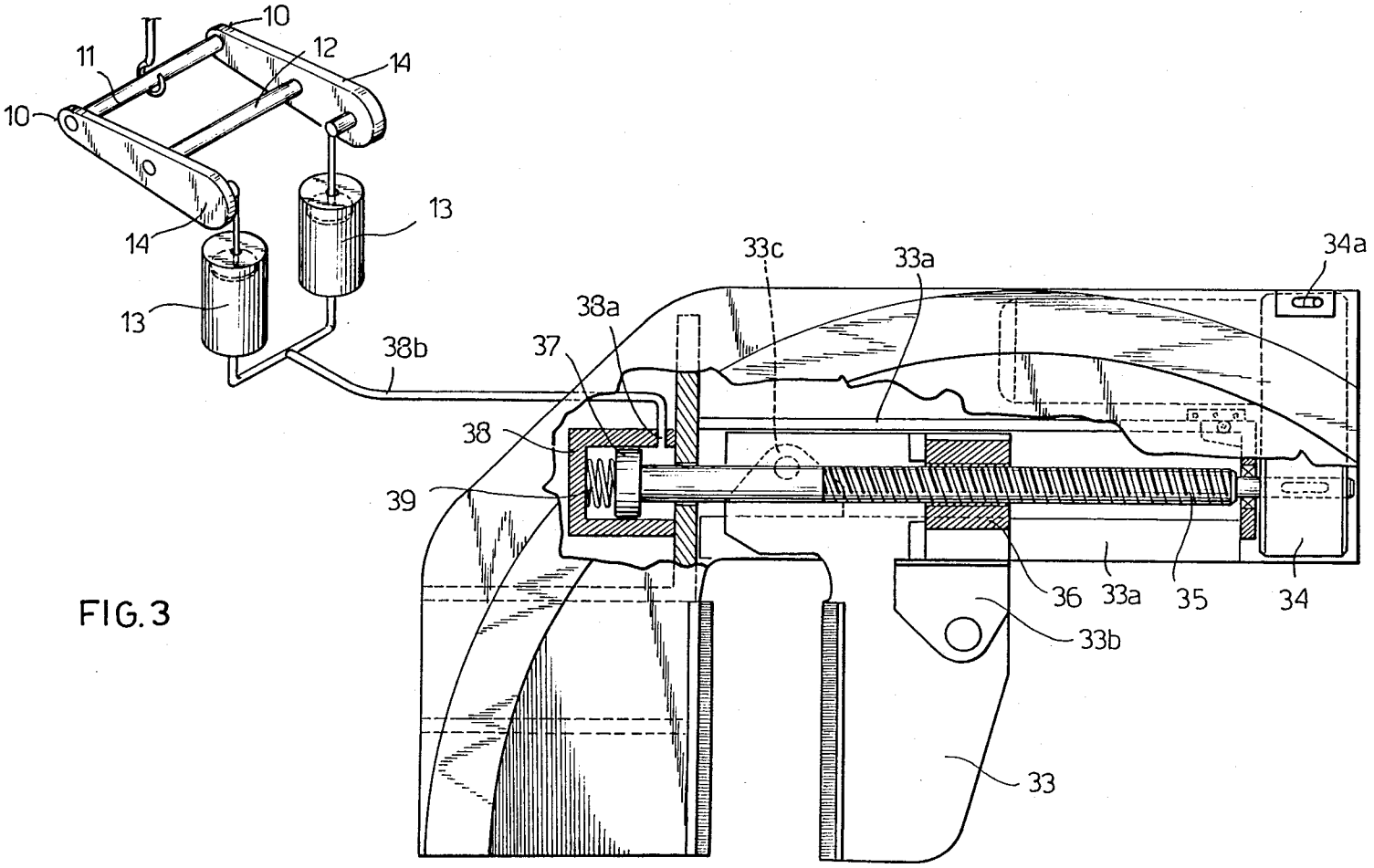
FIG. 3 is an enlarged partially sectioned view showing the actuating means of the clamping and the hydraulic locking system.

Referring first to FIGS. 1 and 3, it will be noted that R indicates a hollow cylindrical body. This is lifted by the hook of a crane acting along the line X—X of FIG. 1. A pair of levers 10 are connected at one end by a pin 11 which receives the hook. At an intermediate zone the levers 10 have a pivot 12 around which a support 20 can rotate. This support comprises at least three rollers 21. To this set a fourth roller 22 may be added; this roller 22 being smaller than the others in diameter. These rollers are mounted one beside the other, forming two pairs capable of receiving the substantially circular guide 30. The center of the circular guide is comprised in a semicircumference having as its diametral base the diagonal D of the hollow cylindrical body R. The guide 30 is part of the rotating clamp 31 which comprises a jaw 32 integral with the guide 30, and a moving jaw 33 which can be remotely controlled so as to approach or move away from the jaw 32 integral with the guide 30.

The connection between the pair of levers 10 and the support 20, as said above, is the pivot 12 around which the support 20 can rotate. The support 20 assumes a defined position with respect to the levers 10 by means of two hydraulic cylinders 13 having their pistons linked at the fork-shaped end 14 of lever 10, opposite to the end having the pin 11. The body of the cylinder is connected, through the plate 24, to the support 20. In this way, the more weight bears on the support 20, the more the cylinders 13 tend to close, as both the end 14 and the plate 24 approach each other. The oil pressure produced by this movement in the cylinders 13 is transferred to the clamp by the closed circuit hydraulic system, as it will be described hereunder.

At least one of the rollers 21 is driven by a gearmotor M, for instance of the hollow shaft type. The shaft 25, integral with the output of the gearmotor M, drives the pinions 26 provided at both ends of the shaft 25. The pinions 26 drive the crown wheel 27 which in turn drives the gear train 28 and 29. The gear 29 is integral with one of the rollers 21 which in turn is integral with a toothed pinion **21*a* which meshes with a rack 30*a* integral with the guide 30. The pinion 21*a*, by means of the gearmotor M, can thus change the position of the rotating clamp 31 with respect to the support 20**.

A device for moving the jaw 33 is located in the rotating clamp 31. A gearmotor 34 with a hollow shaft is also used here (FIG. 3): it rotates a screw 35 which meshes with a nut 36 connected with the moving jaw 33. The nut 36 and the jaw 33 are supported by guides 33a and guided by a pairs of shoes **33*b* and 33*c*. The screw 35 projects beyond the nut 36 to form the shaft of a piston 37 which moves in a cylinder 38 within which a spring 39 is foreseen. The cylinder 38 is provided with an oil inlet 38*a*. This inlet 38*a* is connected by a tube 38*b* to the outlet of the cylinders 13**.

The gearmotor 34 is prevented from rotating by a pin in the slot **34*a* which allows the jaw 33, the screw 35 and the gearmotor 34 to move together whenever the oil under pressure admitted through the inlet 38*a* moves the piston 37. The spring 39** returns the piston to a rest position whenever the cylindrical body R is laid on the ground.

In operation, the gearmotor 34 is activated when a wall of the cylindrical body R is placed between the two jaws 32 and 33. Thus, the screw 35 brings the jaw 33 into contact with the inner wall of the hollow body, while the jaw 32 is brought into contact with the outer wall. At this point the gearmotor stops and the crane begins the lifting of the device, according to the present invention. The crane hook in lifting will close the cylinders 13; this will increase the oil pressure in the tube **38*b* of the closed circuit system, and at the inlet 38*a*. This oil pressure acts on the piston 37 overcoming the resistence of the spring 39, bringing the jaws 32 and 33** closer to one another. This action is particularly important, for instance when it is necessary to lift coils having ice between the steel sheets. With the grip of the jaws this ice can be driven off. It is therefore important that the closing force of the clamp is maintained and even increased automatically by the lifting of the hook.

All the complex shown in FIG. 1 weighs on the crane hook acting along the axis X—X. The center of gravity of the roll R coincides with the geometrical centre O of the same. The centre of gravity G of the complex weighing on the crane is found at a point higher and to the left of the centre of gravity O of the coil R alone in FIG. 1. The operator, while the crane hook is lifting the hollow cylindrical body R, activates the pinion 21*a* to bring the centre of gravity G onto the axis X—X along which the crane hook lies.

A further embodiment is shown in FIG. 4. In this, a pair of levers 10 identical to those in the preceding embodiment are used. The support 20, identical to that already described, is connected to the levers 10 in a symmetrical way with respect to the axis X—X of FIG. 1. In this case the rotating clamp 31' is slightly modified with respect to clamp 31, in order to grip, turn and deposit coils R' of smaller diameter and greater height than coils R.

In any case the radius of the guide 30 can be less than half of the maximum transverse diagonal D of the hollow cylindrical body R.

Figure 2:
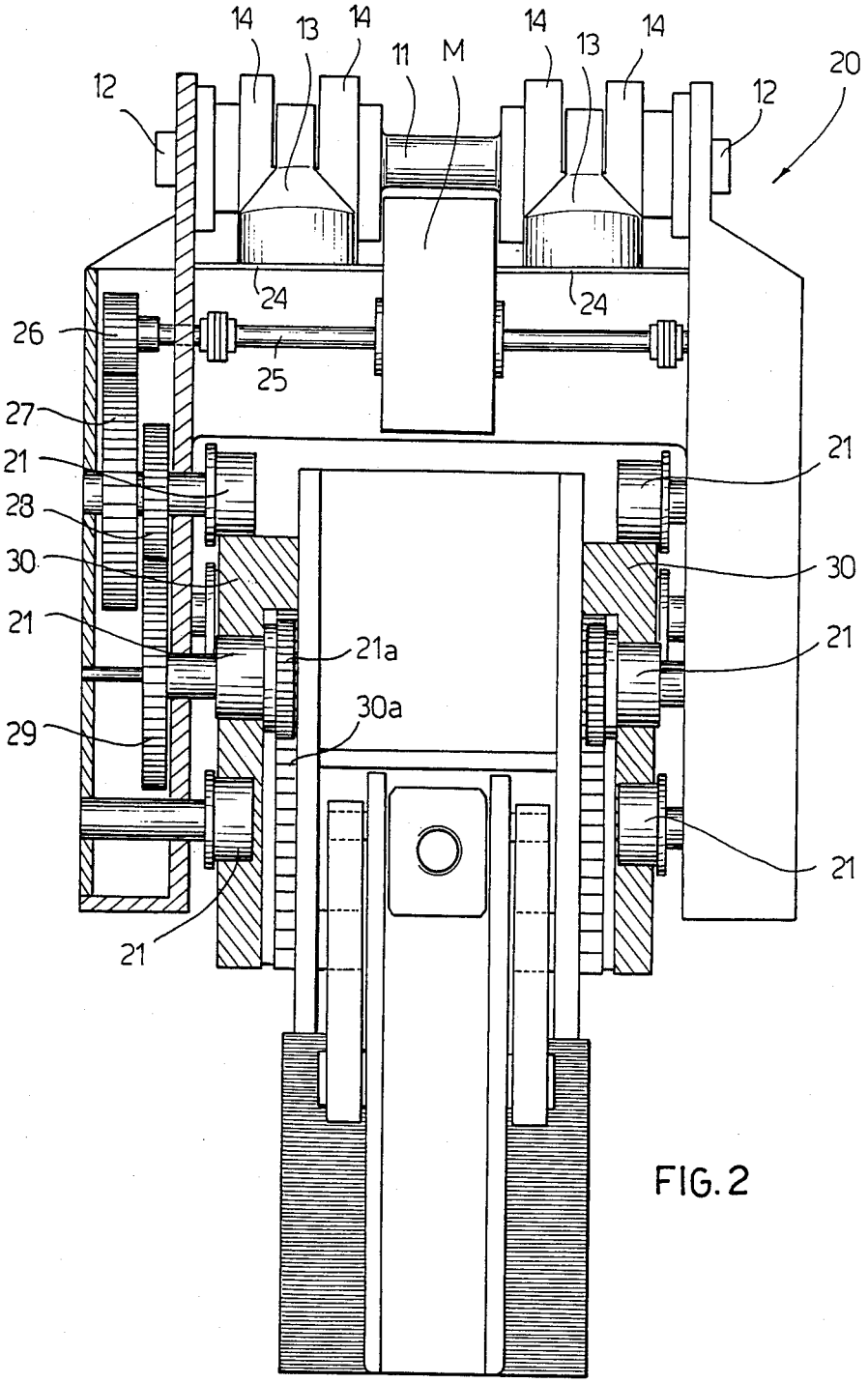
FIG. 2 is a side view rotated 90° with respect to FIG. 1 and partially sectioned along line 2—2 of FIG. 1.
Figure 5:
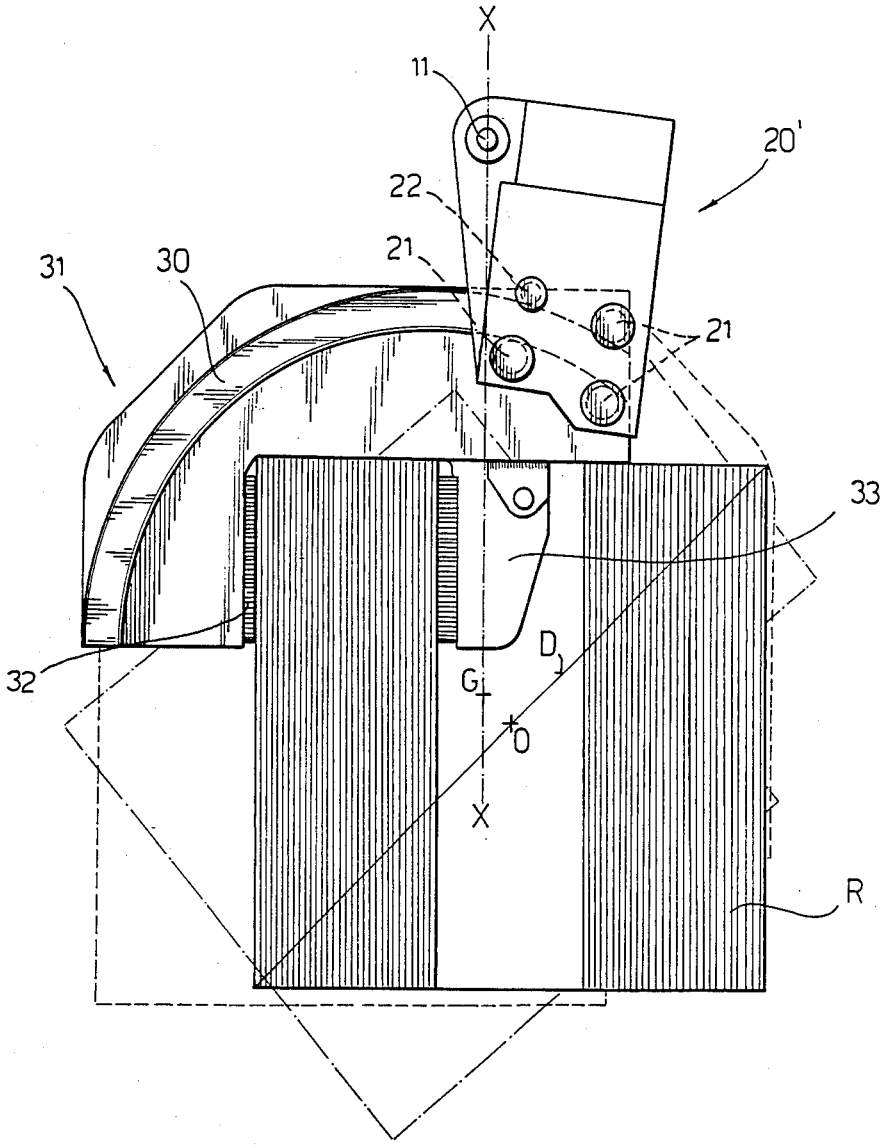
FIG. 5 is a side view of a further embodiment which foresees a load cell.
Figure 6:
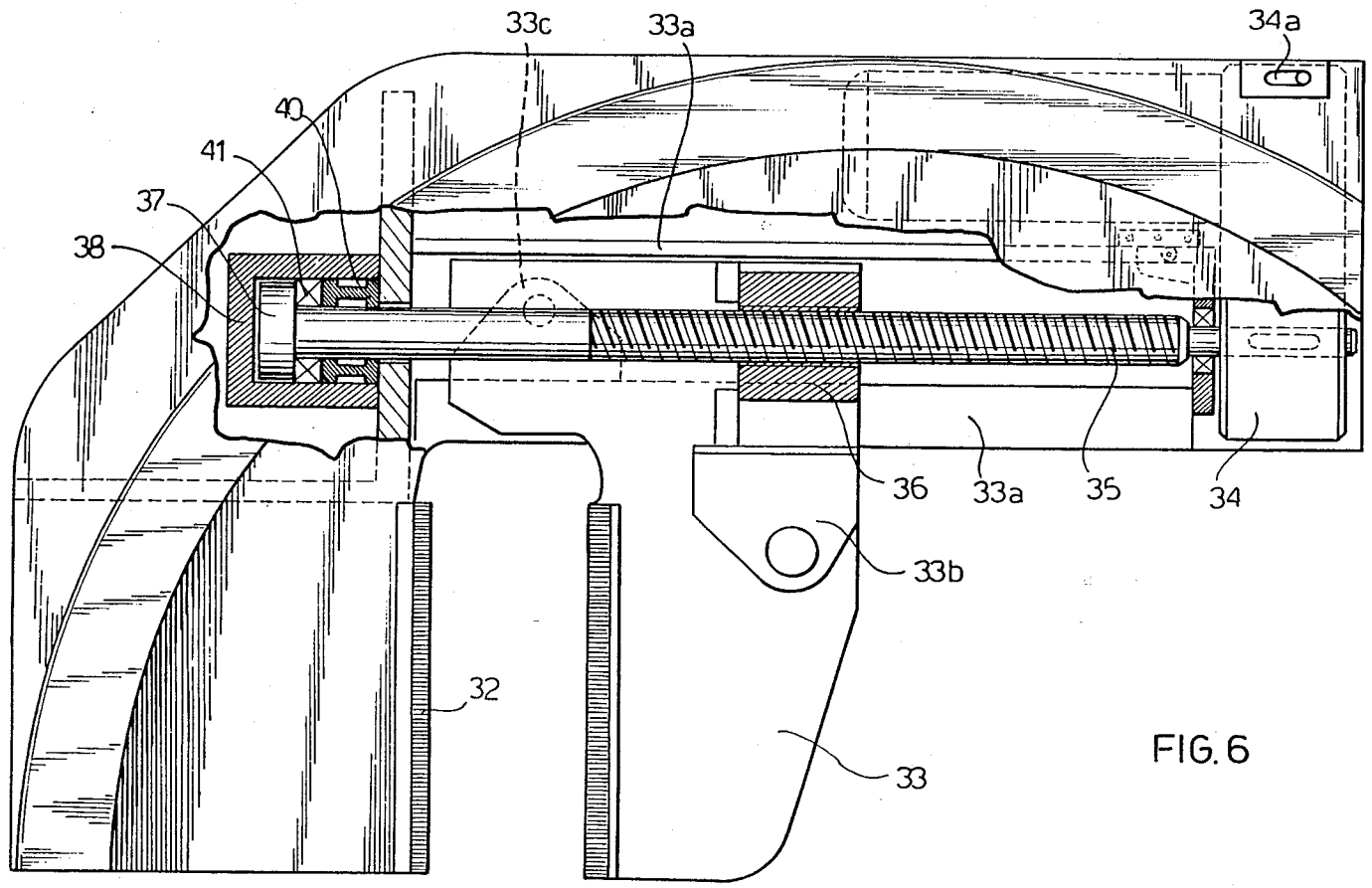
FIG. 6 is an enlarged view partially in section showing the actuating means of one of the clamp jaw with the relative holding force compensation system which consists of a load cell.

FIGS. 5 and 6 show the apparatus fitted with a holding force compensation system comprising load cell. In this embodiment many items are identical to those of FIGS. 1 to 3 and have been marked with the same numbers. In this case the pin 11 which is used as a hooking means of the crane is integral with a one-piece support 20' on which the rollers 21 and 22 are mounted. The clamp shifting system is identical to the one previously described. In this embodiment a load cell 40 (FIG. 6) encircling the screw 35 is foreseen, the load cell being between the thrust bearing 41 and the wall integral with the stationary jaw 32. When the holding force of the jaw 33 tends to reduce, the cell 40 drives the screw 35 till the holding force is brought back to its initial value.

There is no possibility then of the load slipping off.

I claim:

1. An electromechanical apparatus for handling and tilting hollow cylindrical bodies (R) such as reels of sheet metal comprising a rotating clamp (31) having two jaws (32 and 33) which hold, by means of a nut (36) travelling along a rotating screw (35) driven by a motor (34), the external and internal walls respectively of the cylindrical body (R), the rotating clamp being connected to a crane hooking device by means of a support (20, 20') moving along a guide (30) provided on the rotating clamp body (31), wherein the hold on the internal wall of the body (R) takes place only along a portion of it, a means (13, 38*b*, 37, 38; 40) being provided to compensate the reduction in the holding force produced during the rotation of the hollow cylindrical body (R) characterized by the compensating means (13, 38*b*, 37, 38; 40 causing an additional movement of the rotating screw (35) in a direction to move the jaws closer together.

2. An electromechanical apparatus according to claim 1, characterized in that the guide (30) has a radius of less than half of the maximum transversal diagonal (D) of the hollow cylindrical body (R).

3. An electromechanical apparatus according to claim 1, characterized in that the compensating means consists of a hydraulic circuit, comprising at least a hydraulic cylinder (13) actuated through a lever (11) by the weight of the hollow body itself (R) which is connected in closed circuit to another cylinder (38) which effects a further closing of the jaws (32, 33).

4. An electromechanical apparatus according to claim 1, characterized in that the compensating means consists of a load cell (40) which detects the holding force and actuates the motor (34) driving the rotating screw (35), so that a reduction in the holding force is immediately compensated and cancelled by moving the jaws closer together.

5. An electromechanical apparatus according to claim 4, characterized in that the load cell (40) has an annular shape and is mounted on the shaft of the screw (35).

6. An electromechanical apparatus for handling and tilting hollow cylindrical bodies (R) such as reels of sheet metal comprising a rotating clamp (31) having two jaws (32 and 33) which hold, by means of a nut (36) travelling along a rotating screw (35) driven by a motor (34), the external and internal walls respectively of the cylindrical body (R), the rotating clamp being connected to a crane hooking device by means of a support (20, 20') moving along a guide (30) provided on the rotating clamp body (31), wherein the hold on the internal wall of the body (R) takes place only along a portion of it, a means (13, 38*b*, 37, 38; 40) being provided to compensate the reduction in the holding force produced during the rotation of the hollow cylindrical body (R) characterized by the compensating means (13, 38*b*, 37, 38; 40) causing an additional movement of the rotating screw (35) in a direction to move the jaws closer together.

* * * * *